US005805456A

United States Patent [19]

Higham et al.

[11] Patent Number: 5,805,456

[45] Date of Patent: Sep. 8, 1998

[54] DEVICE AND METHOD FOR PROVIDING ACCESS TO ITEMS TO BE DISPENSED

[75] Inventors: John D. Higham, Menlo Park; Peter P. Godlewski, San Carlos, both of Calif.

[73] Assignee: Omnicell Technologies, Inc., Palo Alto, Calif.

[21] Appl. No.: 274,926

[22] Filed: Jul. 14, 1994

[51] Int. Cl.[6] ..... G07F 11/00

[52] U.S. Cl. ..... 364/479.06; 364/479.01; 364/479.07; 364/479.14; 312/215

[58] Field of Search ..... 364/479, 403; 312/35; 221/2, 5, 34, 92; 235/22, 424, 425; 161/601, 641, 679, 684

[56] References Cited

U.S. PATENT DOCUMENTS

| | | | |
|---|---|---|---|
| 3,556,342 | 1/1971 | Guarr | 221/2 |
| 3,715,148 | 2/1973 | Beals | 312/209 |
| 3,744,867 | 7/1973 | Shaw | 312/234 |
| 3,917,045 | 11/1975 | Williams et al. | 194/4 C |
| 4,019,793 | 4/1977 | Gerding | 312/209 |
| 4,179,724 | 12/1979 | Bonhomme | 361/391 |
| 4,209,211 | 6/1980 | Alford | 312/215 |
| 4,267,942 | 5/1981 | Wick, Jr. et al. | 221/2 |
| 4,360,125 | 11/1982 | Martindale et al. | 221/2 |
| 4,473,884 | 9/1984 | Behl | 364/479 |
| 4,635,053 | 1/1987 | Banks et al. | 340/825.31 |
| 4,695,954 | 9/1987 | Rose et al. | 364/413 |
| 4,737,910 | 4/1988 | Kimbrow | 364/403 |
| 4,783,740 | 11/1988 | Ishizawa et al. | 364/403 |
| 4,785,969 | 11/1988 | McLaughlin | 221/2 |
| 4,811,764 | 3/1989 | McLaughlin | 141/98 |
| 4,847,764 | 7/1989 | Halvorson | 364/413.02 |
| 4,942,275 | 7/1990 | Addey et al. | 200/308 |
| 4,962,491 | 10/1990 | Schaeffer | 368/21 |
| 4,967,928 | 11/1990 | Carter | 221/2 |
| 5,014,875 | 5/1991 | McLaughlin et al. | 221/2 |
| 5,047,948 | 9/1991 | Turner | 364/479 |
| 5,055,660 | 10/1991 | Bertagna et al. | 235/472 |
| 5,069,511 | 12/1991 | Swets et al. | 312/107.5 |
| 5,259,668 | 11/1993 | Teufel et al. | 312/249.11 |
| 5,263,596 | 11/1993 | Williams | 221/153 |
| 5,267,174 | 11/1993 | Kaufman et al. | 364/479 |
| 5,346,297 | 9/1994 | Colson, Jr. et al. | 312/215 |
| 5,381,315 | 1/1995 | Hamaguchi et al. | 361/727 |

*Primary Examiner*—Reba I. Elmore
*Assistant Examiner*—Sheela S. Rao
*Attorney, Agent, or Firm*—Townsend and Townsend and Crew LLP

[57] ABSTRACT

The invention provides improved methods and apparatus for providing access to items to be dispensed and for maintaining an inventory of the items. According to one aspect of the invention, a dispensing unit is provided having an enclosure with an interior. A plurality of storage locations are distributed over a surface of the enclosure. Sensors associated with at least some of the individual storage locations are provided. The unit further includes a multiplicity of receptacles disposed within at least some of the storage locations. Sensors associated with at least some of the individual receptacles are provided. A processor is disposed on the enclosure and connected to receive signals from the storage location-associated sensors and the receptacle-associated sensors.

61 Claims, 10 Drawing Sheets

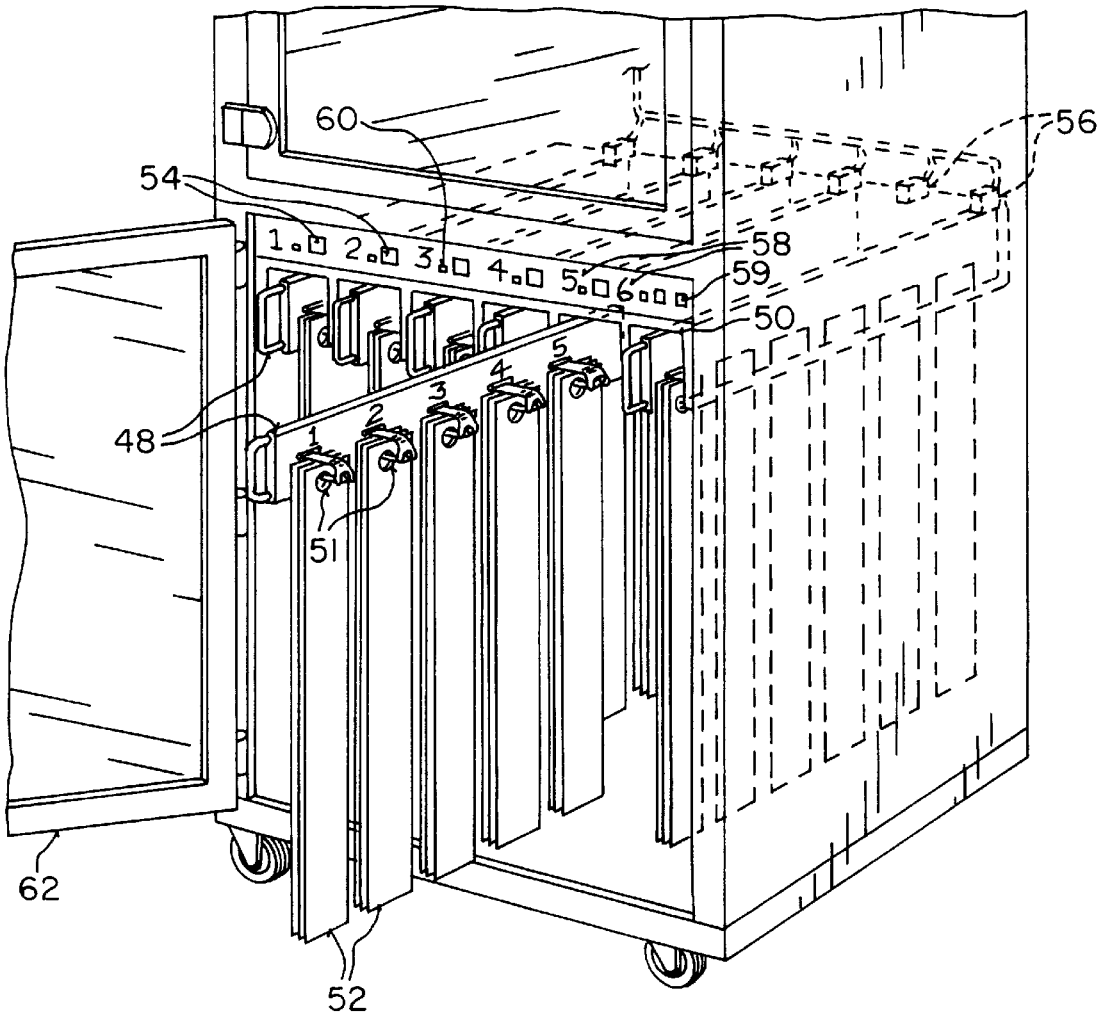
FIG. 3
FIG. 3A
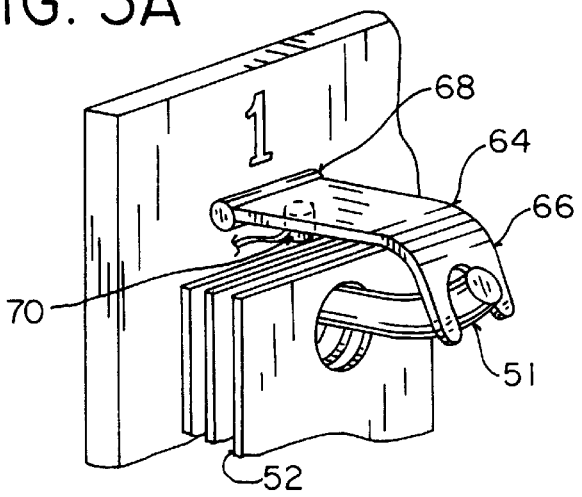

DEVICE AND METHOD FOR PROVIDING ACCESS TO ITEMS TO BE DISPENSED

BACKGROUND OF THE INVENTION

1. Field of the Invention

The invention relates to methods and apparatus for providing access to items to be dispensed, and may find a particular use in the dispensing of medical supplies. The invention further relates maintaining an inventory of the number and type of items dispensed while providing easy and convenient access to the items.

In large medical facilities, inventories of medical supplies are held in storage locations which are often far removed from the patients who use them. To facilitate delivery of the medical supplies from the storage area to the patient, a variety of dispensing systems have been proposed. In one such system, referred to as a "cart exchange" system, dispensing carts are distributed at remote dispensing stations in the medical facility and are periodically exchanged with fully supplied carts. The "used" cart is returned to a central supply area where inventory decreases of particular medical supplies are recorded and the cart is restocked to predetermined "par" levels. These par levels are intended to ensure constant availability of required medical supplies.

In a similar system, individual carts are used but are not removed from their remote locations in the medical facility. Instead, a larger cart holding a variety of medical supplies is circulated throughout the facility to restock individual carts to their par levels.

Although these systems are generally effective in providing medical supplies to remote locations away from the storage area, they suffer from a number of drawbacks. One particular drawback is the potential for stock-outs that can arise if the inventories of the carts are not closely monitored. Adequate inventory monitoring can be problematic due to time limitations on the hospital staff. Depletion of certain items from the carts can pose serious risks to the patients in the medical facility.

To ensure that sufficient supplies are maintained in the carts, overstocking can occur which in turn increases the cost of the medical facility's inventory system by requiring more items to be maintained in inventory than are actually required. Excessive restocking is also demanding on the hospital staff who must devote more of their time to monitoring the carts to ensure that sufficient supplies are available.

Another drawback of the above-described inventory systems is the lack of security provided for the supplies maintained on the carts. Since access to the items can usually be gained without recording user identification information, medical personal may neglect or forget to record removal of the accessed supplies which can introduce errors or inefficiencies into the medical facility's inventory system. Lack of security can also discourage the return of unused supplies. Without a record of user access and removal, medical personnel may often choose to discard the supplies rather than taking the time to return them.

In yet another drawback, no direct data transfer from the supply carts to the hospital inventory and billing systems is provided. This can lead to further inefficiencies in the inventory system.

For these and other reasons, it would be desirable to provide a dispensing system allowing easy and convenient access to the items to be dispensed while also maintaining an accurate inventory (including both removal and replacement) of the number and type of items to be dispensed. Such a system should reduce the possibility of stock outs and provide accountability by controlling access to the supplies and allowing easy return of unused items. The system should also allow for inventories to be maintained at minimum levels and should be able to directly supply inventory information to the medical facility's inventory and billing systems.

2. Description of the Background Art

U.S. Pat. No. 5,263,596 describes a subassembly for use in a medical dispenser station which dispenses pharmaceutical items in single quantities from a locked storage location.

U.S. Pat. No. 3,715,148 describes a medicine dispensing cabinet having a plurality of sliding drawers and a plurality of dispensing trays.

U.S. Pat. No. 3,556,342 describes a medicine dispensing apparatus for dispensing medicines from a cabinet and into a hopper.

U.S. Pat. No. 5,047,948 describes a medication dispensing system for dispensing medicines into a receptacle in the bottom of a medicine cabinet.

U.S. Pat. No. 4,962,491 describes a portable medication dispenser for visually and audibly indicating the times at which a patient's medications are to be taken.

U.S. Pat. No. 5,014,875 describes a medication dispenser having a housing with a plurality of locked drawers which are stocked with selected pharmaceutical items. Access to the items is allowed upon keyboard entry of a predetermined access code.

U.S. Pat. No. 3,917,045 describes a drug dispensing apparatus for automatically dispensing one or more individual drug doses to a common collection area as required by a patient.

U.S. Pat. No. 4,019,793 describes a pharmaceutical dosage distribution apparatus having an enclosure with a door and a plurality of trays.

U.S. Pat. No. 4,267,942 describes a pharmaceutical storage and dispensing cabinet for dispensing items into a retrieval tray for removal.

U.S. Pat. No. 4,360,125 describes a medication dispenser which can provide a medication alert signal in accordance with a desired medication regimen.

U.S. Pat. No. 4,473,884 describes a portable medical dispensing unit for storing pills. The dispensing unit is programmed with a medication schedule which causes visual and audio signals when it is time for medication to be consumed.

U.S. Pat. No. 4,635,053 describes an apparatus for monitoring and restricting access to individual items which are provided with a unique identifying code. The codes are scanned by a microprocessor to identify removal of the item.

U.S. Pat. No. 4,695,954 describes a system and method for dispensing medications prescribed by a doctor. The system includes a medical dispenser which can read prescription information from a memory device and make the medications available to the patient at the prescribed times.

U.S. Pat. No. 4,785,969 describes a medication dispensing system for controlled programmed dispensing of medication to a patient and for creating a retrievable patient medication record.

U.S. Pat. No. 4,811,764 describes a medication dispenser station having rotatable carousels with vertically open compartments containing individual doses of a medication.

U.S. Pat. No. 4,847,764 describes a system for dispensing medications in a health care institution.

U.S. Pat. No. 4,942,275 describes a control panel face for mounting to a control member.

U.S. Pat. No. 4,967,928 describes a medication cart for dispensing medicines during a nurse's rounds.

U.S. Pat. No. 5,055,660 describes a transaction monitoring and security system for recording data from the sale of articles.

U.S. Pat. No. 5,069,511 describes a pharmaceutical cart for retaining a plurality of dispensing bins on shelves.

U.S. Pat. No. 5,259,668 describes a medication cart having a base formed of a pair of molded plates interconnected by rails. The plates have molded grooves and holes for receiving structural elements of the cart.

U.S. Pat. No. 5,267,174 describes a medication delivery device having a housing containing separate storage locations for holding medication dosages away from access by the user.

SUMMARY OF THE INVENTION

The invention provides a dispensing unit having an enclosure with an interior. A plurality of storage locations are distributed over a surface of the enclosure. Sensors are associated with at least some of the individual storage locations to sense when the storage locations have been accessed. A multiplicity of receptacles are disposed within at least some of the storage locations, and sensors are associated with at least some of the individual receptacles to sense when an item has been removed (or in some cases returned) from the receptacles. A processor is disposed on the enclosure and connected to receive signals from the storage location-associated sensors and the receptacles-associated sensors.

In an exemplary embodiment, at least one of the storage locations comprises a drawer that can be withdrawn from the interior of the enclosure. The drawer preferably includes at least one divider to divide the drawer into the multiplicity of receptacles. In an exemplary aspect of this embodiment, the storage-location sensors comprise a switch disposed near each drawer for sensing when a drawer has been opened. When the drawer is withdrawn from the interior, the switch sends a signal to the processor indicating that this drawer has been accessed. In another exemplary aspect, the receptacle-associated sensors comprise touch-sensitive buttons. Preferably, the buttons are disposed in a row on the surface of the enclosure and in an order which corresponds to the order of receptacles in the drawer.

In one particular aspect, a signal received from a switch when one of the drawers is opened is used by the processor to set the row of buttons to correspond to the receptacles in the accessed drawer. This configuration allows one row of buttons to be used with more than one drawer, and reduces the number of buttons required for the unit.

In another particular aspect, each button is assigned a unique button identification symbol, e.g., a number. The identification symbol is disposed in close proximity to each of the buttons. The same button identification symbols are also disposed in close proximity to each of the receptacles. With this configuration, when one of the drawers is opened and one of the buttons is selected, removal (or replacement) of an item from the receptacle having the same identification symbol as the button is recorded.

In yet another particular aspect, each drawer includes a unique drawer identification symbol that corresponds to the unique button identification symbols. Associating the drawers with the buttons in this manner is advantageous when providing the unit with means for displaying a list of items held by the unit, means for entering a selection from the list of the items held in the dispensing unit into the processor, and a plurality of visual indicators connected to the processor and in close proximity to the buttons. With such a configuration, when a selection from the list of items is entered, the visual indicator in close proximity to the button having the same identification symbol as the drawer containing the item is actuated. This allows a user to easily identify which drawer contains the selected item. In a further aspect, when the drawer having the item is accessed, the visual indicator in close proximity to the button having the same identification symbol as the receptacle having the item is actuated. This allows for easy identification of the receptacle having the item.

In another exemplary aspect, the unit is provided with a horizontal shelf having the buttons disposed thereon. The drawers are slidably disposed along the shelf and are generally aligned with the buttons such that each button corresponds to the closest drawer. Means are provided for displaying a list of items held by the unit for entering a selection from the list of the items held in the dispensing unit into the processor. A plurality of visual indicators connected to the processor and in close proximity to the buttons are provided, with each button corresponding to the closest visual indicator. With this configuration, entry of a selection from the list of names actuates the visual indicator corresponding to the drawer having the item. This allows for easy identification of the drawer having the desired item. Once the drawer having the item is accessed, the visual indicator corresponding to the button having the same symbol as the receptacle having the item is actuated. This allows for easy identification of the receptacle having the item once the drawer is opened.

In another exemplary embodiment, at least one of the storage locations comprises a rack having a plurality of pegs. The pegs are disposed along the rack to define the receptacles. In an exemplary aspect, the storage-location sensors comprise a switch disposed near each rack for sensing the opening of the racks. In another aspect, the receptacle-associated sensors comprise touch-sensitive buttons. Preferably, the buttons are disposed in a row on the surface of the enclosure.

In one particular exemplary aspect, the signal received from one of the switches when one of the racks is open is used by the processor to set the row of buttons to correspond to the pegs in the accessed rack. This configuration allows a single row of buttons to be used with more than one rack. Each time a rack is accessed, the buttons are set to correspond to that particular rack.

In another particular aspect, the buttons correspond visually with the pegs by a unique button identification symbol in close proximity in corresponding to each button and each peg. When a rack is withdrawn and one of the buttons is selected, removal (or replacement) of an item from the peg having the same identification symbol as the button is recorded.

In yet another particular aspect, the unit further includes a horizontal shelf with the buttons being disposed along the shelf. The racks are slidably disposed along the shelf and generally aligned with the buttons such that each button corresponds to the closest rack. Means are provided for displaying a list of items held by the unit, and means for entering a selection from the list of the items held in the dispensing unit into the processor are provided. A plurality of visual indicators connected to the processor and in close proximity to the buttons are provided, with each button corresponding to the closest visual indicator. With this configuration, entry of a selection from the list of items actuates the visual indicator corresponding to the rack having the item. This allows for easy visual identification of the rack having the desired item. When the rack having the item has been accessed, the visual indicator corresponding to the button having the same identification symbol as the peg having the item is actuated. This provides for easy visual identification of the peg having the desired item once the rack has been withdrawn. As each item is withdrawn, the associated button is pushed once to record removal.

In still another aspect, the unit further includes means for selectively preventing access to the storage locations. Means are also provided for opening the preventing means to permit access to a desired receptacle in response to input of patient and user identification information into the processor. In one aspect, the storage locations comprise a plurality of racks, and withdrawal of one of the racks causes the preventing means to block access to all remaining racks. In another aspect, the storage locations comprise a plurality of drawers, and withdrawal of one of the drawers causes the preventing means to block access to all remaining drawers.

In another particular aspect, the interior is accessible through a doorway, and means are provided across the doorway for selectively blocking access to the storage locations while permitting access to the receptacle-associated sensors at all times. Means for opening the blocking means are provided to permit access to a desired receptacle selected from the plurality of receptacles in response to actuation of the receptacle-associated sensor is provided.

The invention further provides a dispensing unit comprising an enclosure having an interior. A plurality of pull-out compartments on the enclosure are provided with at least some of the compartments being provided with an array of receptacles. A sensor is associated with and in close proximity to each of the receptacles for sensing when an item has been removed from one of the receptacles. A processor is disposed on the enclosure and connected to receive signals from the sensors. In a preferred aspect, the compartments comprise drawers having dividers to form the receptacles, and the sensors comprise touch-sensitive buttons disposed on the drawers.

In one particular aspect, the dividers are adjustable so that the number and size of the receptacles can be varied. Sensor covers are provided to prevent access to selected sensors based on the adjustment of the dividers so that each receptacle will have only one accessible button.

In a particular preferred aspect, a visual indicator is disposed in close proximity to each sensor. In another aspect, means are provided for displaying a list of items held in the unit and for entering a selection from the list of the items held in the dispensing unit into the processor. With this configuration, entry of a selection from the list of items actuates the visual indicator in close proximity to the receptacle having the selected item. This allows for convenient identification of a particular receptacle having the item.

In another particular aspect, a cover is provided for each of the receptacles. The covers are preferably connected to the dividers by hinges so that the receptacles can be accessed by lifting an edge of the covers. In another aspect, the covers are preferably substantially transparent to allow visual access to the receptacles. Sensing means are provided for sensing when the covers have been displaced. In one aspect, the sensing means comprises an electromagnetic sensor or an optical sensor. When one of the covers is lifted, a signal is sent to the processor to produce a record of the access. This information can then be used to determine which users have been accessing the receptacles.

In another aspect, locks are provided for locking the cover to the receptacles to prevent access to the receptacles. The locks are in communication with the processor which provides signals to lock or unlock the covers. Preferably, the processor sends a signal to unlock one of the covers after both user, patient, and item identification information have been entered into the processor.

In still another particular aspect, the buttons are disposed beneath the covers and an aperture is disposed in each of the covers with the aperture being aligned with the button. With this configuration, the buttons can be accessed through the apertures while the covers are closed. Once a button has been actuated, the cover is unlocked to allow access to that particular receptacle. This configuration provides security to the dispensing unit by ensuring that access to a particular receptacle will not be obtained until the associated button has been selected to record removal of an item.

In another aspect of the dispensing unit, at least some of the compartments comprise racks with the receptacles being disposed along pegs on the racks. The sensors are disposed along the racks and near each peg. In one particular embodiment, the sensors are disposed on the pegs for sensing when an item has been removed from the associated peg. This embodiment allows an item to be removed from a peg and to have the removal automatically recorded. In another embodiment, the sensors comprise touch-sensitive buttons. With this embodiment, once an item has been removed (or replaced) from the peg, the associated button is touched to record removal of the item.

In a preferable aspect, a visual indicator in close proximity to each button is provided. Means are provided for displaying a list of items held by the unit and for entering a selection from the list of the items held in the dispensing unit into the processor. Entry of a selection from the list of the items actuates the visual indicator in close proximity to the button having the selected item. This allows for easy visual identification of the peg having the desired item.

In yet another aspect, the sensor is an optical sensor disposed along a side of the drawer. When a user's hand is inserted into the drawer, the optical sensor detects that one of the receptacles has been accessed.

The invention provides a method for recording inventory information related to removal and addition of items from an enclosure. According to the method, a first sensor on the enclosure is actuated to produce a first signal associated with the location of a receptacle. A second sensor on the enclosure is actuated to produce a second signal associated with the location of the receptacle. An item is transferred to or from the receptacle, and the transfer is recorded based on an address of the location which is based at least in part on the first and second signals.

In an exemplary aspect, the first sensor is actuated by withdrawing a drawer or rack holding the item at least partially from the enclosure or by touching a button associated with the drawer or rack holding the item. In another aspect, the second sensor is actuated by touching a button corresponding to the location of the item on the drawer or rack or by removing the item.

In another aspect, the item to be removed or added is selected from a list of items, and selection of the item from the list actuates a visual indicator in close proximity to the drawer or rack having the item. This indicates which drawer or rack has the item. In another aspect, a visual indicator in close proximity to the button which corresponds to the location of the item in the drawer or on the rack is actuated after the drawer or rack has been withdrawn. This indicates the location of the item in the drawer or on the rack.

In yet another aspect, a unique button identification symbol is provided for each button. The symbols are disposed in close proximity to each button and also near each item location. The button is actuated after visually locating both the button identification symbol near the item to be dispensed and the button having the same identification symbol.

In still another aspect, access to the items is prevented until patient identification information has been entered into the dispensing unit.

The invention provides a method for recording inventory information related to removal and addition of items from an enclosure having an array of receptacles disposed in a holding apparatus. According to the method, the holding apparatus is at least partially withdrawn from the enclosure to gain access to the items. An item to be removed or added is visually located and is then removed or added. A sensor in close proximity and corresponding to the receptacle having the item is actuated to record removal or addition of the item, preferably by touching a touch-sensitive button.

In one particular aspect, access to one of the receptacles is sensed (independently of sensing the addition or removal of an item) and a record of the access is produced. The record of receptacle access can then be compared with the record of item removal, and the record of the item removal can then be updated based on the record of receptacle access. In still another aspect, access to the receptacles is prevented until both user and patient identification information have been recorded. In another aspect, access to the receptacles is prevented until actuation of one of the sensors. In another aspect, access to a selected number of the receptacles is prevented based on the user identification information. This provides heightened security by ensuring that only selected individuals can gain access to particular items.

BRIEF DESCRIPTION OF THE DRAWINGS

FIG. 3 illustrates a portion of a dispensing unit having a plurality of pull-out racks, with each rack being provided with a plurality of pegs for holding an inventory of items according to the present invention.

FIG. 3A is a detailed view of one of the pegs of FIG. 3 and further showing a sensor associated with the peg for sensing removal of an item from the peg according to the present invention.

DETAILED DESCRIPTION OF THE SPECIFIC EMBODIMENTS

The invention provides improved methods and apparatus for adding and removing items to or from a dispensing unit and for maintaining an inventory of the items. The methods and apparatus of the invention are particularly useful with a "see and touch" type of dispensing unit as described generally in U.S. patent application Ser. No. 08/095,619, filed Jul. 21, 1993 (Attorney Docket No. 16166-1), the disclosure of which is herein incorporated by reference. Such a unit allows a user to visually locate an item to be removed and to record removal of the item by pressing a touch-sensitive button in close proximity to the storage location of the item. A similar procedure is used when placing items into the unit.

Figure 1:
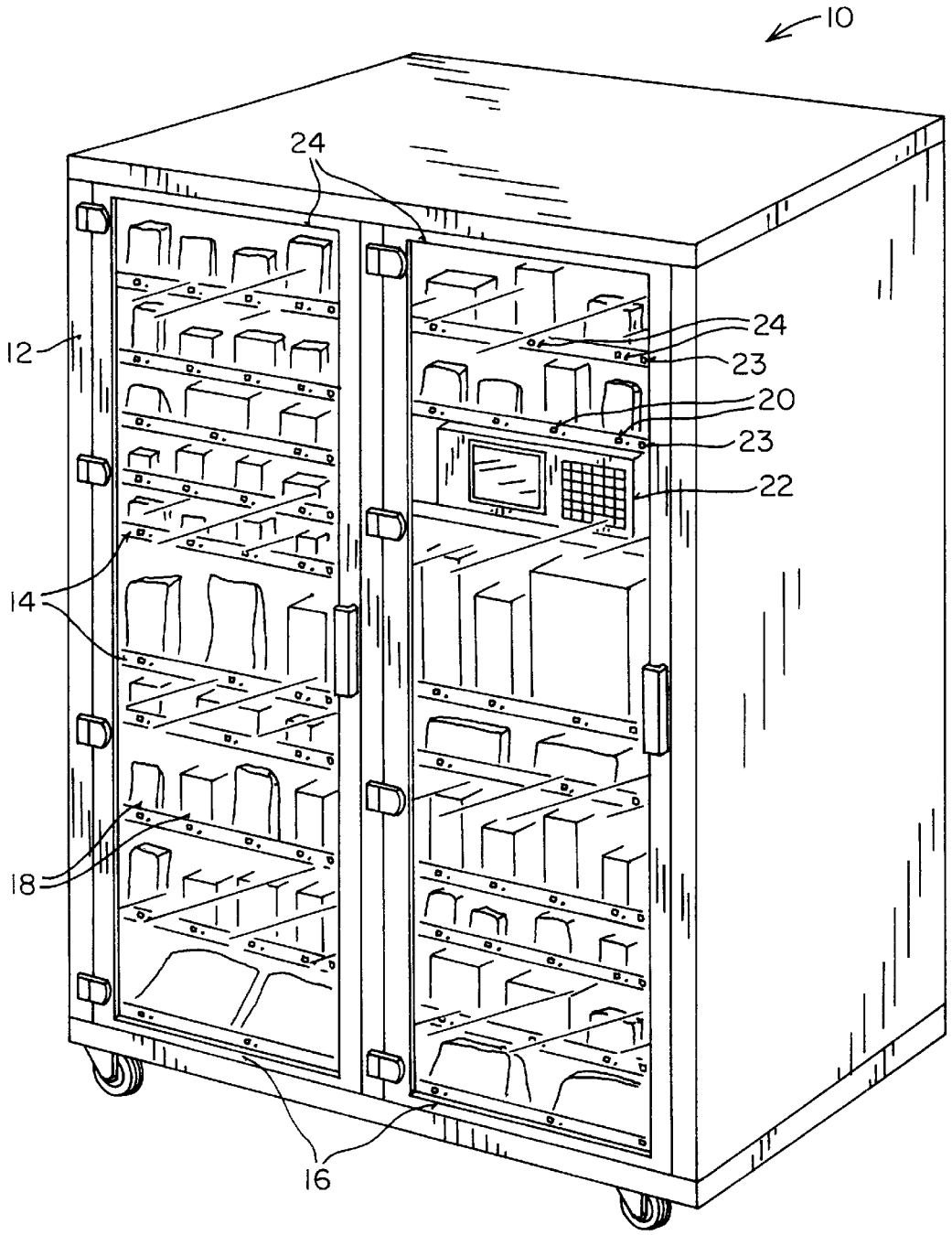
FIG. 1 illustrates a dispensing unit having a plurality of touch-sensitive buttons and corresponding visual indicators for recording inventory information.

An exemplary dispensing unit of the type just described is shown in FIG. 1. Briefly, the dispensing unit 10 includes an enclosure 12 and a plurality of adjustable shelves 14. optionally, the enclosure 12 can be divided into a plurality of compartments 16 to increase the number of shelves 14 that can be disposed in the enclosure 12. Each shelf 14 can be further subdivided to form a plurality of storage locations 18. Disposed on the shelves 14 and near each storage location 18 are touch-sensitive buttons 20. The buttons 20 are connected to a processor 22 which receives signals from the buttons 20 when actuated.

The buttons 20 are disposed on the shelves 14 so that each storage location 18 is associated with a button 20. When an item is to be placed in or removed from a shelf 14, the button 20 in close proximity to the storage location 18 holding the item is actuated. Actuation of the button 20 sends a signal to the processor 22 to record removal of an item from or placement of an item into that particular storage location 18.

A return item button 23 is disposed at the end of each shelf 14. Actuation of the return item button 23 sends a signal to the processor 22 to place the buttons 20 on that particular shelf 14 in a credit mode. An item can then be returned to one of the storage locations 18 on that particular shelf 14, and the associated button 20 depressed to record replacement of the item.

A plurality of visual indicators 24 are also disposed on the shelves and near each of the buttons 20 so that each button 20 has a corresponding visual indicator 24. The visual indicators 24 are used to assist in locating an item to be removed from the dispensing unit 10. The processor 22 contains a list of all of the items held in the dispensing unit 10. From this list, a user can select the desired item to be removed by entering the selection into the processor 22. The processor 22 then sends a signal to actuate the visual indicator 24 in close proximity to the storage location 18 having the item.

The dispensing unit further includes a plurality of doors 26 which can be used to provide security for the items held in the unit 10. The doors 26 are preferably transparent and can be locked to prevent access to the items in the unit as described in more detail hereinafter.

The dispensing unit 10 has proven to be generally successful in maintaining an inventory of items dispensed from the unit. The invention as described in detail hereinafter provides improvements to dispensing units of the type described in FIG. 1. In one aspect of the invention, the storage locations are configured such that they can at least partially be pulled out or withdrawn from the dispensing unit. This configuration allows easier access to the storage locations. Exemplary apparatus for providing pull-out storage locations include drawers, racks, bins, hangars, and the like. Another particular advantage in using pull-out storage locations is that the storage locations can be further subdivided into a plurality of receptacles. The receptacles can be arranged in either one-dimensional or a multi-dimensional array. For example, in the case of drawers, dividers can be placed therein to form either a single row of receptacles or a plurality of rows. This allows the drawer to be subdivided in a desired manner according to the number and size of the receptacles required.

When providing the dispensing unit with a plurality of receptacles, a separate sensor can be provided for each receptacle to maintain an inventory of items either placed in or removed from that particular receptacle. For example, in the case of a drawer having a plurality of receptacles, each receptacle would be provided with a sensor so that when an item is withdrawn from one of the receptacles, the associated sensor can be actuated to record removal of the item from the receptacle. In a similar manner, the sensor could also be used to record placement of an item into the receptacle. Exemplary sensors for maintaining a record of the inventory of the items in the receptacles include touch-sensitive buttons, weight sensors, optical sensors, electromagnetic sensors, capacitative sensors, and the like.

In another aspect of the invention, a second set of sensors can be utilized to determine when the storage locations have been accessed. Use of storage location-associated sensors is particularly advantageous when having a plurality of storage locations with a plurality of receptacles in at least some of the storage locations. By providing the storage location-associated sensors, a common set of receptacle-associated sensors can be used for the receptacles of each of the storage locations rather than providing each receptacle with a separate sensor. When a particular storage location is accessed, the storage location-associated sensor sends a signal to the processor indicating that that particular storage location has been accessed. The processor can then use this information to set the common set of receptacle-associated sensors to correspond to the receptacle locations of the accessed drawer. After an item has been removed from a particular receptacle, the associated sensor can then be actuated to record removal of the item from that particular receptacle. Providing a common set of receptacle-associated sensors is advantageous because it reduces the circuitry otherwise required to provide each receptacle with a separate sensor. Exemplary sensors for sensing when a particular storage location has been accessed include electromechanical switches, optical sensors, electromagnetic sensors, capacitative sensors, and the like.

In another particular aspect, the dispensing unit can be placed in a return item mode by actuating a return item sensor near each of the storage locations. Actuation of the return item sensor sends a signal to the processor to place the receptacle-associated sensors in return mode. An item can then be replaced and the associated receptacle sensor actuated to record replacement of the item.

Security for the items held in the dispensing unit can be provided by a variety of devices. One such device is a lock disposed near each pull-out storage location to prevent withdrawal of the drawer until certain information, such as user identification and patient identification information, has been entered into the processor. When the required information has been entered into the processor, the processor can send a signal to unlock all of the storage locations, or only the particular storage location having the item.

Locks can also be provided for the pull-out storage locations so that once a storage location has been withdrawn, all remaining storage locations are locked. Locking the remaining storage locations in this manner is advantageous in preventing confusion as to which receptacles correspond to the common set of receptacle-associated sensors. Since only one storage location can be accessed at a time, the receptacle-associated sensors will correspond to the receptacles of the withdrawn storage location.

In the case where all of the storage locations are unlocked by the processor, withdrawal of one of the storage locations will preferably cause all of the remaining storage locations to become locked. This ensures that only one storage location can be accessed at a time. When an item is removed from a receptacle having the item, the associated receptacle sensor can be actuated to record removal of the item. In a preferred aspect, if the user was diligent in recording removal by actuating the sensor, the processor sends the signal to unlock all of the storage locations so that a subsequent item can be removed. This allows a user access to all of the storage locations as long as the user is diligent in recording removal of an item from an accessed storage location. If a particular storage location has been withdrawn, and a receptacle-associated sensor was not actuated, all of the storage locations will become locked upon closure of the accessed storage location. To gain further access to the storage locations, the user will be required to re-enter identification information into the processor. An emergency by-pass switch can be provided on the unit so that all of the storage locations can be accessed without being required to enter identification information into the processor. Exemplary locking devices include electromechanical locks, electromagnetic locks, and the like.

When more than one item is to be removed from or placed into a particular receptacle, the associated receptacle sensor can be actuated according to the number of items to be removed or added. For example, if three items were to be removed from a particular receptacle, the sensor could be actuated three different times to record removal of the three items.

To assist the user in determining whether the sensor has been actuated, the sensor can optionally be provided with an audio indicator. For example, if the receptacle sensor were a touch-activated sensor, when the button is depressed, a beep would be produced to indicate that the button has been actuated. In addition, the number of items taken can be visually displayed on the screen of the associated processor.

This serves as verification that the touch-activated sensor has been depressed the correct number of times.

Figure 2:
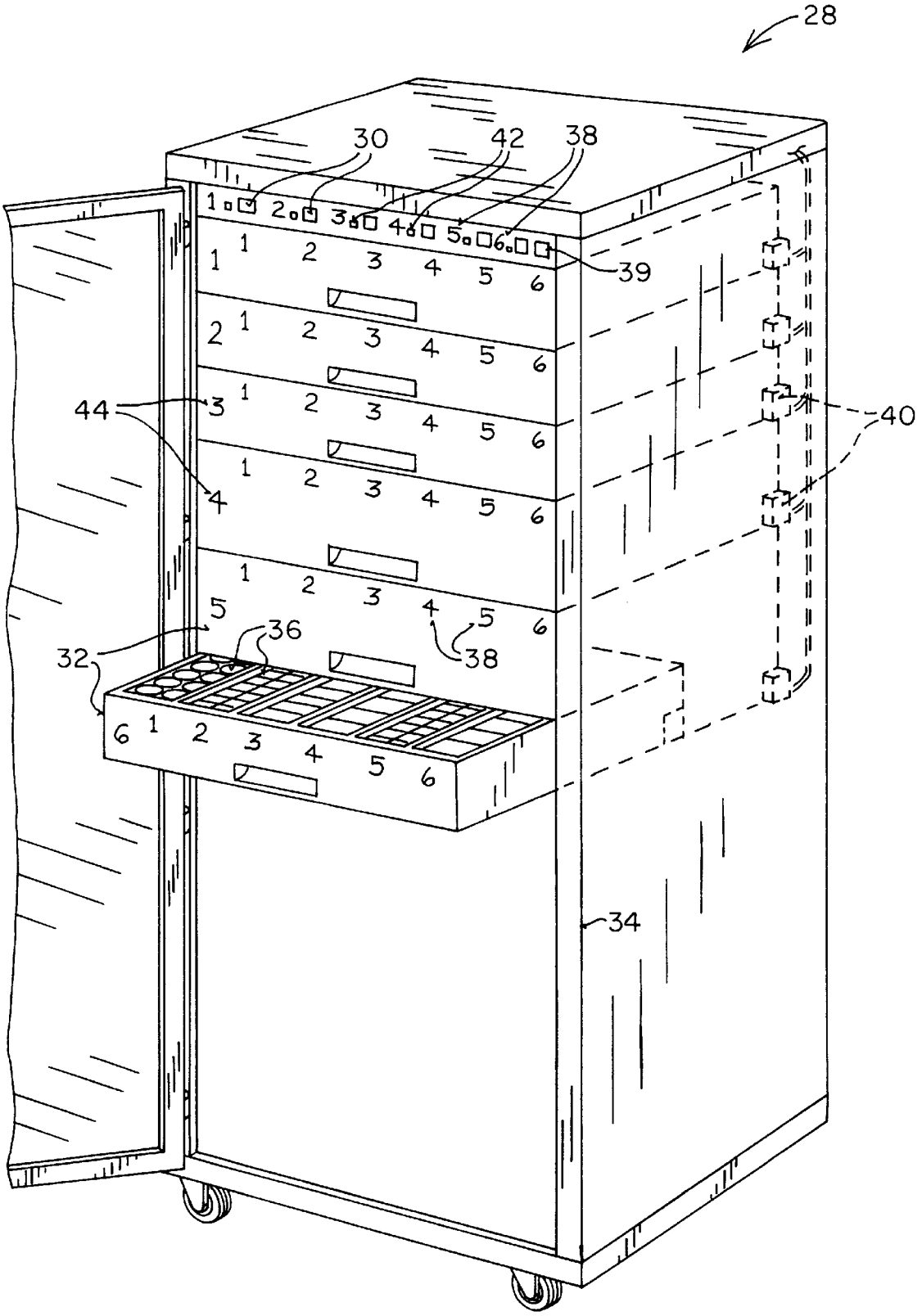
FIG. 2 illustrates a dispensing unit having a row of touch-sensitive buttons with corresponding visual indicators which correspond to a plurality of pull-out drawers below the row of buttons according to the present invention.

Referring now to FIG. 2, an exemplary embodiment of a dispensing unit 28 having a row of touch-sensitive buttons 30. The row of buttons 30 are common to a plurality of drawers 32 that are slidably disposed within a frame 34. The dispensing unit 28 can be a stand alone unit, or can alternatively be a portion of a larger dispensing unit of the type shown in FIG. 1. At least some of the drawers 32 are provided with a plurality of receptacles 36 for holding items.

Preferably, each button 30 will be provided with a unique button identification symbol 38, which will usually be a numeral. The receptacles 36 of each drawer 32 will preferably be provided with the same unique reference symbol 38 as its corresponding button 30. For example, as shown in FIG. 2, if the unit 20 is provided with six touch sensitive buttons 30, the buttons 30 can numbered one to six. Accordingly, the receptacles 36 for each of the drawers 32 will also be numbered from one to six (or any number less than six if there are fewer than six receptacles in the drawer). Of course, this assumes that the number of receptacles 36 will be equal to or less than the number of buttons 30 so that a receptacle 36 will always have a corresponding button 30.

Associated with each drawer 32 is a sensor 40 for sensing when the drawer 30 has been pulled out from the frame 34. Each of the sensors 40 and the buttons 30 are connected to a processor (not shown) for receiving signals from the sensors 40 or the buttons 30. When a particular drawer 32 is opened, the associated sensor 40 sends a signal to the processor indicating access to the drawer 32. The processor then sends a signal to set the buttons 30 to correspond to the receptacles 36 of the withdrawn drawer 32. An item can then be either placed into or removed from a particular receptacle and the button 30 having the same identification symbol 38 as the accessed receptacle 36 is touched to record removal or addition of the item to or from the dispensing unit 28. Additional items can also be removed or added from or to the receptacles 36 of the withdrawn drawer 32 with an inventory being maintained by selecting the associated button 30. Once the drawer 32 is closed, another can be withdrawn for removal of items in the same manner.

To assist in locating a particular item, a plurality of visual indicators 42 are disposed near each of the buttons 30 and each of the drawers 32 are provided with a unique drawer identification number 44 that correspond to the button identification symbols 38. With this configuration, the processor can send a signal to actuate the visual indicator 42 near the button 30 having the same identification symbol as the drawer identification symbol 44 for the drawer 32 having the item. Once the drawer 32 having the item is withdrawn, the processor can send another signal to actuate the visual indicator 42 near the button 30 having the same identification symbol as the receptacle 36 having the item. Alternatively, instead of providing the drawer identification symbols 44, a second set of visual indicators can optionally be provided on the drawers 32, with each drawer 32 having a separate visual indicator. The processor can then send a signal to actuate the drawer-associated visual indicator on the drawer 32 having the item.

The sensors 40 can optionally be combined with locking mechanisms, e.g., mechanical, electromagnetic, or the like, such that when one drawer 32 is pulled out the others are locked until the extended drawer 32 is returned. This insures that the buttons 30 will always correspond to the receptacles 36 of the withdrawn drawer 32.

A return item button 39 can be provided at the end of the row of touch-sensitive buttons 30 for placing the dispensing unit 28 in return mode. When return item button 39 is depressed, a signal is sent to the processor to place the touch-sensitive buttons in return mode. A drawer 32 can then be accessed, the item returned to the appropriate receptacle 36, and the associated touch-sensitive button 30 depressed to record replacement of the item.

Shown in FIG. 3, is another embodiment of a dispensing unit 46 having a plurality of pull-out racks 48. The racks 48 are slidably disposed along a shelf 50. The dispensing unit 46 can be a stand alone unit, or can alternatively be used in a larger dispensing unit. At least some of the racks 48 include a plurality of pegs 51 for holding items 52. Exemplary items to be held on the pegs 51 include catheters which can be vertically hung from the pegs 51. Disposed near each of the racks 48 are a set of touch-sensitive buttons 54 for recording removal or addition of items. The dispensing unit 46 further includes a plurality of sensors 56 for sensing when the racks 48 have been withdrawn from the shelf 50. Both the buttons 54 and the sensors 56 are connected to a processor (not shown). Optionally, the sensors 56 can also be provided with locks so that when one rack 48 is pulled out the others are locked until the extended rack 48 is returned. This insures that the buttons 54 will always correspond to the pegs 51 of the withdrawn rack 48.

When a particular rack 48 is withdrawn from the shelf 50, a signal is sent from the sensor 56 to the processor to indicate withdrawal of the rack 48. The processor then sets the buttons 54 to correspond to the pegs 51 in a manner similar to the embodiment previously described in connection with FIG. 2. Also as previously described, a set of button identification symbols 58 can be provided for each button 54 and for each peg 51 so that removal of an item 52 from one of the pegs 51 can be recorded by touching the button 54 having the same identification symbol 58 as the peg 51 having the item 52.

A plurality of visual indicators 60 can be disposed near each of the buttons 54, with each button 54 having a separate visual indicator 60. The visual indicators 60 are used to identify which rack 48 and which peg 51 on the rack 48 contains the desired item. For instance, to locate a particular item, the processor can send a signal to the visual indicator 60 near the rack 48 having the item. Preferably, both the buttons 54 and the visual indicator 60 will be disposed above and generally aligned with each of the racks 48 so that each button 54 and each visual indicator 60 correspond to an aligned rack 48. Once the proper rack 48 has been identified and withdrawn, the processor can send a signal to the visual indicator 60 near the button 54 having the same identification symbol 58 as the peg 51 having the item. Alternatively, a second set of visual indicators could be disposed near each peg to indicate which peg 51 has the item.

A return item button 59 can be provided at the end of the row of touch-sensitive buttons 54 for placing the dispensing unit in return mode. When return item button 59 is depressed, a signal is sent to the processor to place the touch-sensitive buttons 54 in return mode. A rack 48 can then be accessed, the item returned to the appropriate peg 51, and the associated touch-sensitive button 54 depressed to record replacement of the item.

The dispensing unit 46 further includes a door 62 which can be used to provide security for the items held in the unit 46 as described in more detail hereinafter.

Referring to FIG. 3A, a detailed view of one of the pegs 51 of the dispensing unit 46 is shown. The peg 51 is provided with a sensor 64 for sensing when one of the items 52 has been removed from or added to the peg 51. The sensor includes a lever 66 that is connected to the rack 48 by a hinge 68. A microswitch 70 is disposed beneath the lever 66 to detect when the lever 66 has been lifted from the peg 51. When the microswitch 70 is actuated, a signal is sent to the processor indicating that one of the items 52 has been either removed from or placed onto the peg 51. This embodiment is particularly advantageous because it eliminates the need for the touch-sensitive buttons 54 described in FIG. 3. The sensor 64 is able to maintain an inventory of the items 52 without requiring the user to touch one of the buttons 54.

Figure 3B:
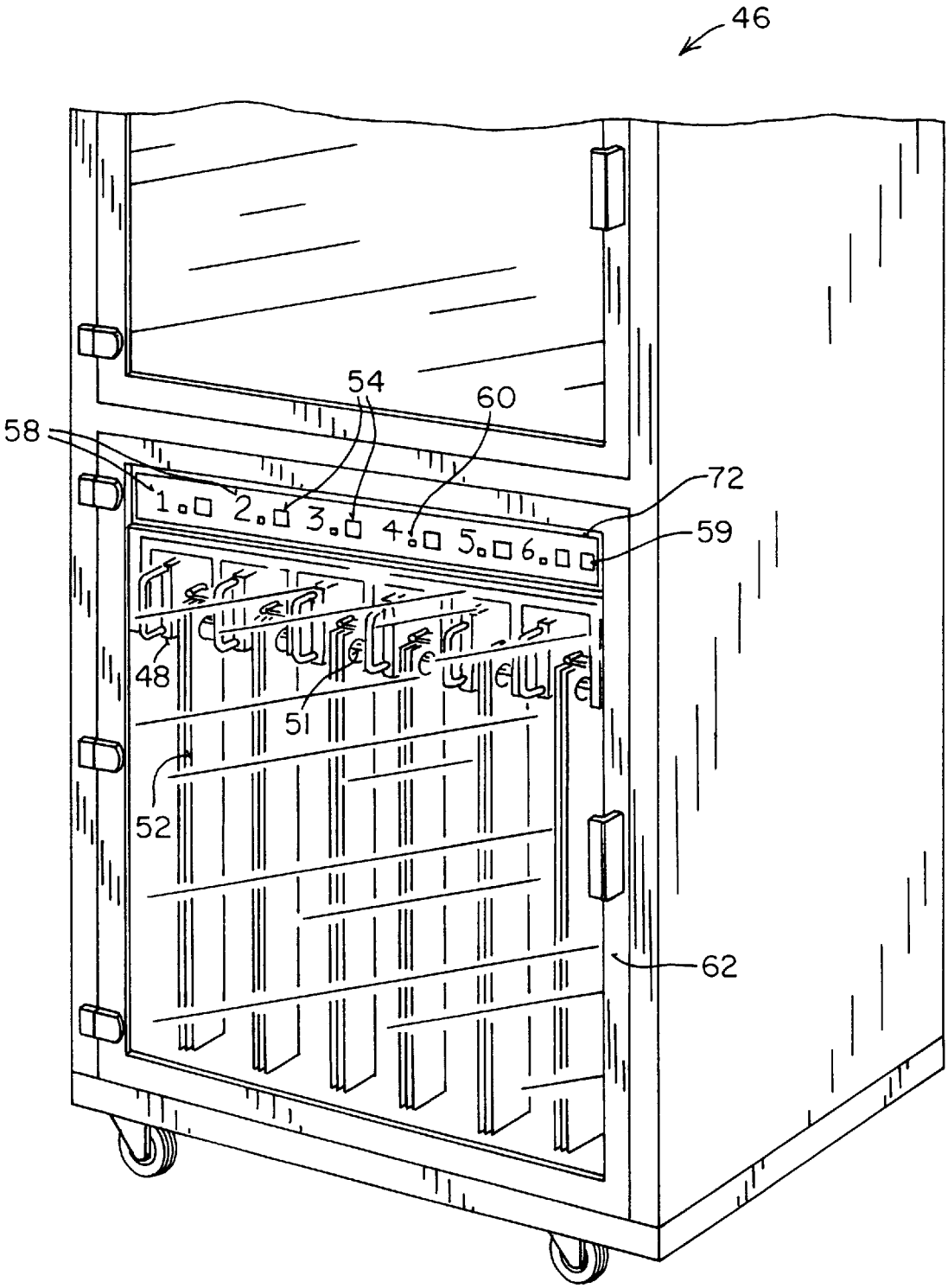
FIG. 3B is an alternative embodiment of the dispensing unit of FIG. 3 showing a door that is provided with an aperture to allow access to the touch-sensitive buttons and visual indicators when the door is closed.

Shown in FIG. 3B is an alternative embodiment of the dispensing unit 46 having an aperture 72 in the door 62. The aperture 72 is disposed near the touch-sensitive buttons 54 so that the buttons 54 are accessible even when the door 62 is closed. As described generally in co-pending U.S. application Ser. No. 08/250,223, filed May 27, 1994 (Attorney Docket No. 16166-1-1), the disclosure of which is herein incorporated by reference, the door 62 is locked until appropriate identification information, such as item identification information, has been entered into the processor. When the required information has been entered into the processor, a signal is sent to unlock the door 62 to provide access to the items in the unit 46. One way to enter item identification information into the processor is to actuate the buttons 54. The aperture 72 provides access to the buttons 54 when the door 62 is closed and locked so that one of the buttons 54 can be selected to indicate that an item is to be removed. Once the button 54 is selected, the door 62 is unlocked to allow access to the items.

In an exemplary method, access to one of the items 52 held in the unit 46 is as follows. After entering user identification information and patient identification information into the processor, the user selects the rack 48 having the item 52 by pressing the button 54 disposed above the rack 48. In one particular aspect, the visual indicator 60 will then be actuated to remind the user which rack 48 was selected. Actuation of the button 54 unlocks the door 62. When the door 62 is opened, the user can pull out the selected rack 48 and remove the item 52 from the peg 51. Removal of the item 52 is then recorded by pressing the button 54 having the same identification number 58 as the peg 51 having the item 52.

Figure 3C:
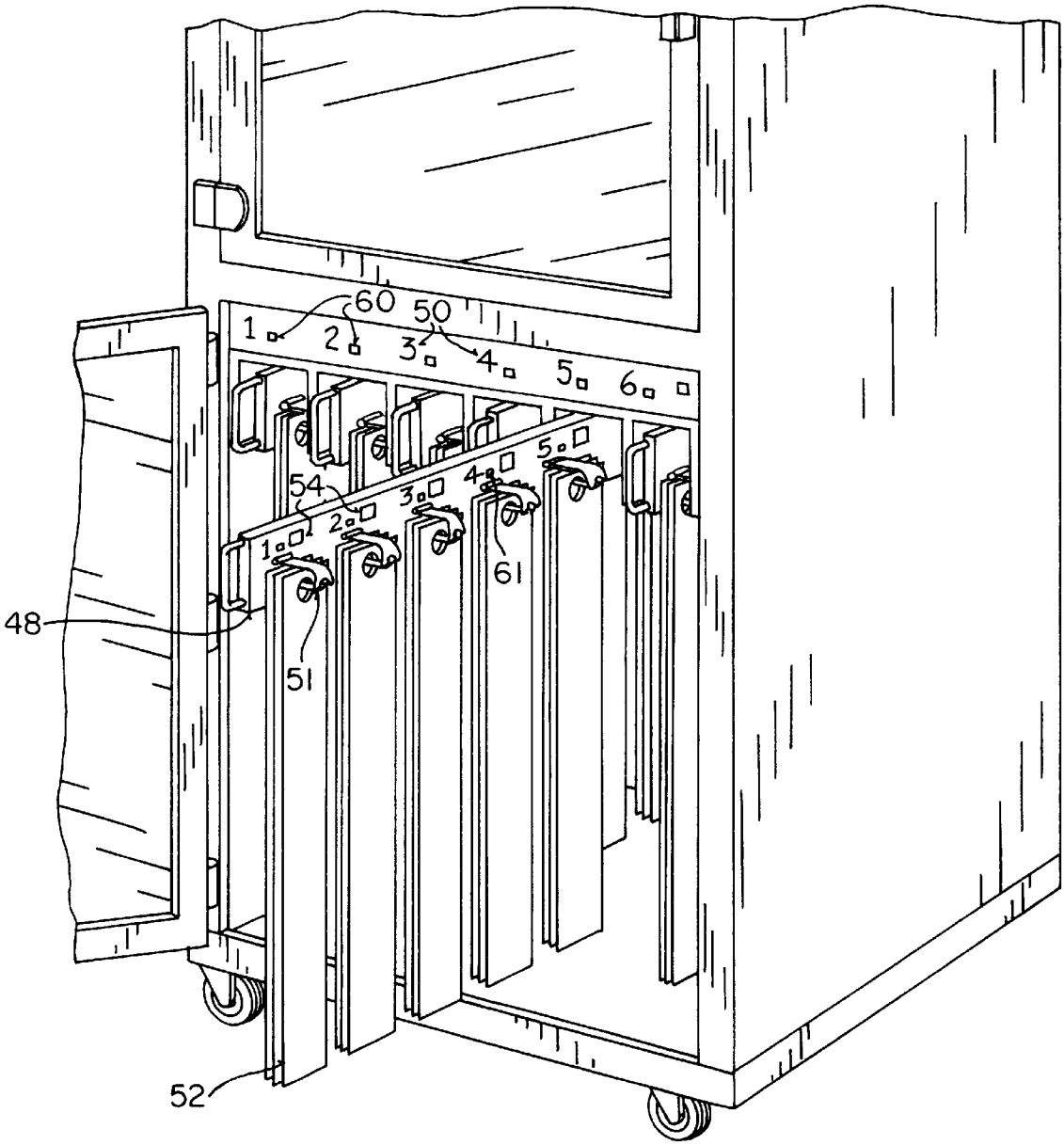
FIG. 3C is a further alternative embodiment of FIG. 3 showing the touch-sensitive buttons and visual indicators disposed along the racks according to the present invention.

Referring to FIG. 3C, another alternative embodiment of the dispensing unit 46 of FIG. 3 is shown with the touch-sensitive buttons 54 being disposed along the racks 48. Each peg 51 is provided with its own button 54 so that removal or addition of an item 52 to or from the peg 51 can be recorded by simply touching the button 54 disposed in closest proximity to the peg 51 having the item 52. To assist in locating the correct rack, visual indicators 60 can be disposed above each of the racks 48. Actuation of one of the visual indicators 60 signifies which rack 48 has the item to be removed. Once the rack 48 has been withdrawn, the peg 51 having the item 52 can be visually located by actuating the visual indicator 60 having the same button identification symbol as the peg 51 having the item 52. Alternatively, a second set of visual indicators 61 can be provided near each of the buttons 54 to indicate which peg 51 has the item.

Figure 4:
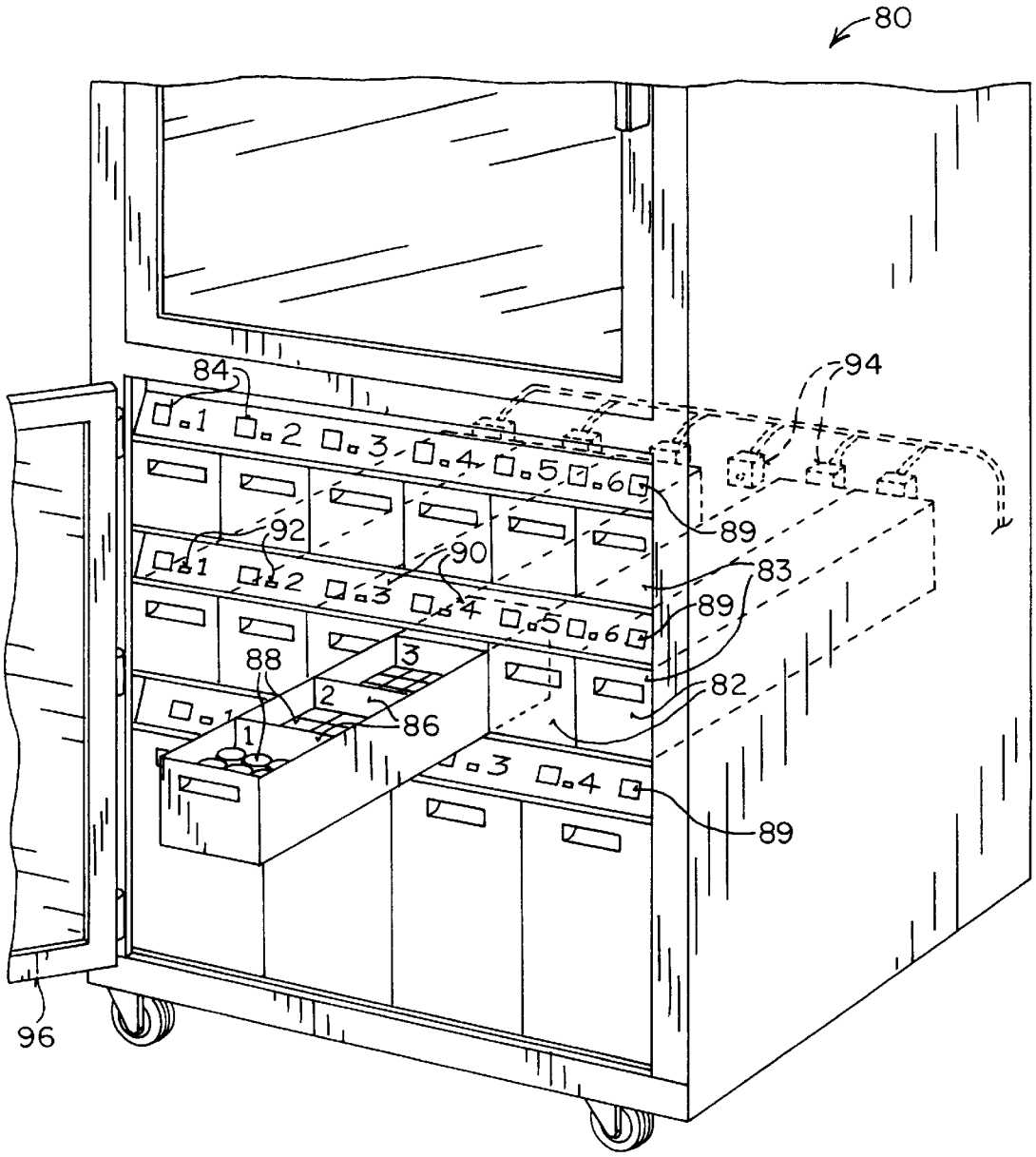
FIG. 4 illustrates a portion of a dispensing unit having a row of touch-sensitive buttons and visual indicators, and a plurality of drawers disposed below the buttons with at least some of the drawers having a plurality of receptacles according to the present invention.

Shown in FIG. 4 is another embodiment of a dispensing unit 80 having a plurality of drawers 82 disposed along rows 83. The dispensing unit 80 can be a stand alone unit, or can alternatively be part of a larger dispensing unit. Each row 83 of drawers 82 has an associated row of touch-sensitive buttons 84 disposed on a panel 86, with each button 84 being generally aligned with a drawer 82. At least some of the drawers 82 include dividers 86 for dividing the drawers 82 into a plurality of receptacles 88. Optionally, a plurality of button identification symbols 90 can be provided for each of the buttons 84 and for each of the receptacles 88 as previously described in FIGS. 2 and 3. The unit 80 further includes a plurality of visual indicators 92, with each button 84 having an associated indicator 92.

The dispensing unit 80 operates in a manner similar to the dispensing unit 46 of FIG. 3 with the drawers 88 corresponding to the racks 48 and the receptacles 88 corresponding to the pegs 51. A plurality of sensors 94 are disposed near each drawer 82 and connected with a processor (not shown) so that withdrawal of one of drawers 82 sends a signal to the processor to indicate access of that particular drawer. The processor then sets the row of buttons 84 over the withdrawn drawer 82 to correspond to the particular receptacles 88 of the withdrawn drawer 82. Removal of an item or placement of an item into one of the receptacles 88 can be recorded by actuating the button 84 having the same identification symbol as the accessed receptacle 88. A return item button 89 is provided at the end of the row of touch-sensitive buttons 84 for placing the dispensing unit 80 in return mode as previously described.

The dispensing unit 80 can further be provided with a door 96 for providing security to the items held in the unit 80. The door 96 can be provided with a plurality of apertures to correspond to the buttons 84 in a manner similar to the apertures previously described in connection with FIG. 3B.

Figure 5:
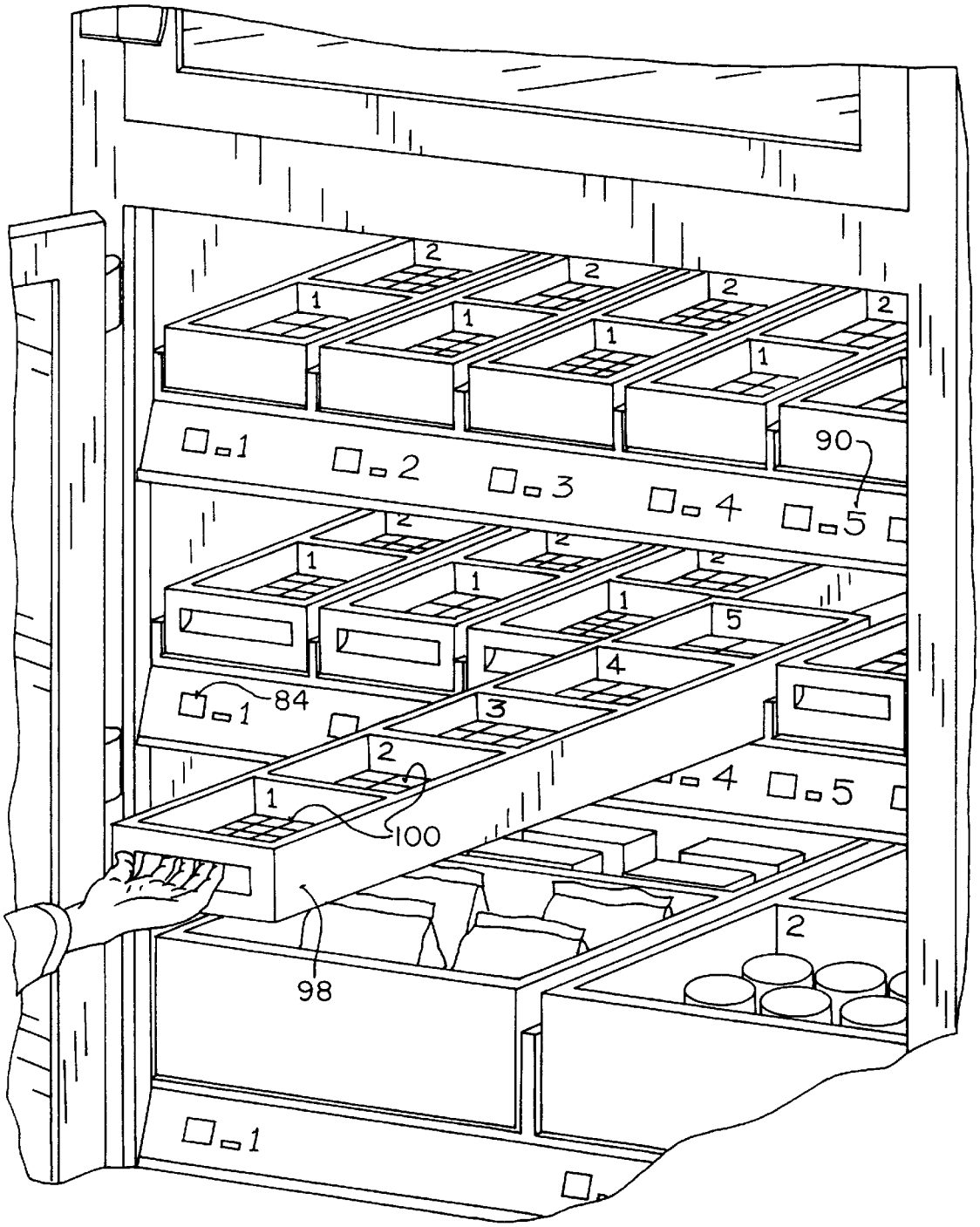
FIG. 5 illustrates a portion of a dispensing unit having a row of touch-sensitive buttons and visual indicators, and a plurality of bins disposed above the buttons on a shelf, with at least some of the bins having a plurality of receptacles.

Referring to FIG. 5, the dispensing unit 80 can be provided with a plurality of removable bins 98 instead of or in addition to the drawers 82 described in FIG. 4. Removal of one of the bins 98 is detected by a sensor (not shown) near the bin 98 which sends a signal to the processor to set the buttons 84 to correspond to a set of receptacles 100 in the bin 98. To record removal of an item from the withdrawn receptacle 100, the button 84 having the same identification symbol 90 as the receptacle 100 having the item is actuated.

Figure 6:
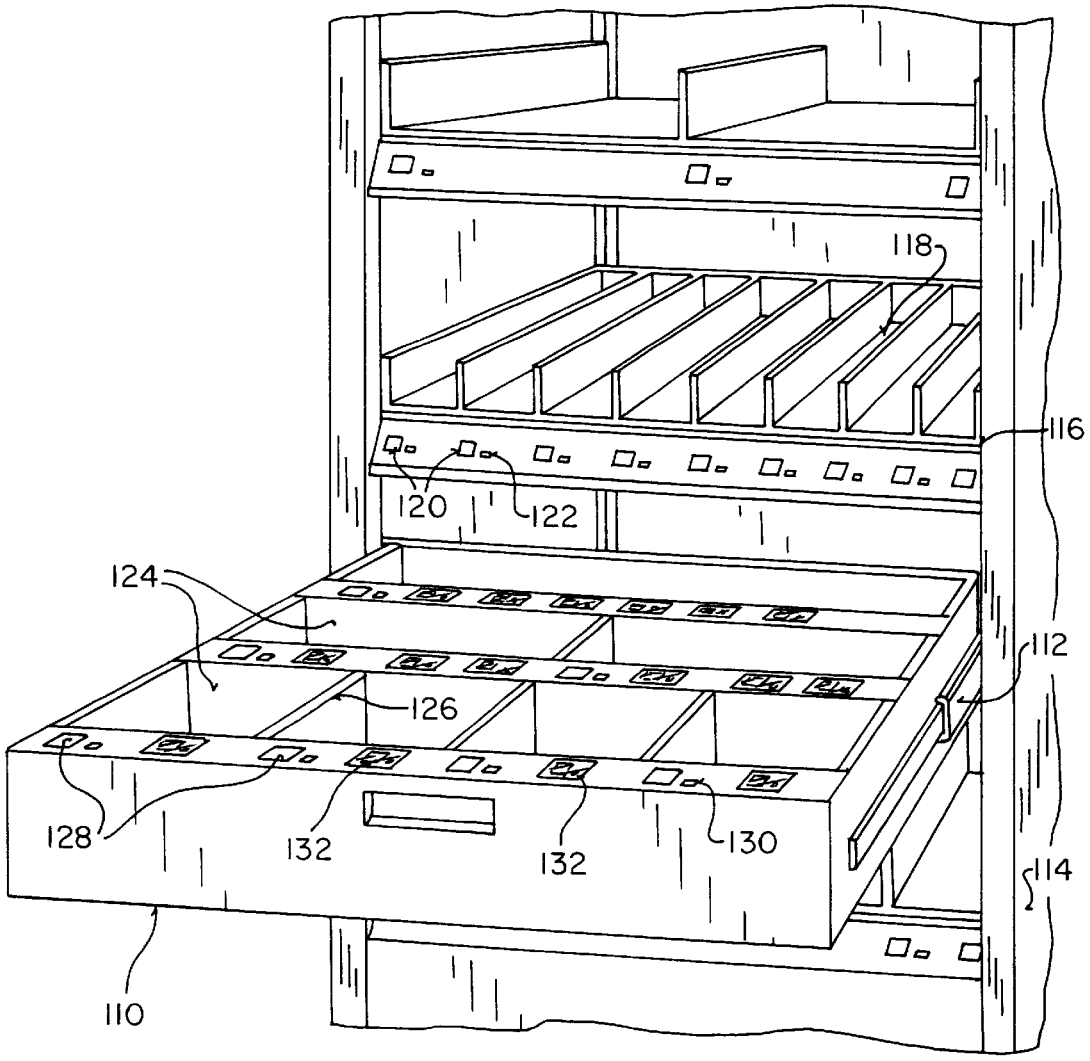
FIG. 6 illustrates a portion of a dispensing unit having a pull-out drawer with a plurality of receptacles therein, with each receptacle being provided with a touch-sensitive button and visual indicators.

Turning to FIG. 6, an exemplary drawer 110 for a dispensing unit of the type previously described in connection with FIG. 1 will be described. The drawer 110 is slidably mounted by a sliding mount 112 to a frame 114. The frame 114 is the same frame used to hold the shelf 116. The shelf 116 is essentially identical to the shelves 14 previously described in connection with FIG. 1 and includes a plurality of storage locations 118, a plurality of touch-sensitive buttons 120, and a plurality of visual indicators 122.

The drawer 110 can be subdivided into a plurality of receptacles 124 by dividers 126. The dividers 126 are adjustable so that the number and size of the receptacles 124 can be varied depending on the size or number of items to be held in the receptacles 124. Disposed near each receptacle 124 is a touch-sensitive button 128 and a corresponding visual indicator 130. Button covers 132 can be provided for covering unnecessary buttons so that only one button 120 will be associated with each receptacle 124.

The buttons 120 and the visual indicators 130 are connected to a processor (not shown). When an item is removed from or placed into a particular receptacle 124, removal or placement of the item can be recorded by touching the button 128 disposed adjacent the receptacle 124 having the item. To assist in locating the receptacle 124 having the item, the processor can send a signal to actuate the visual indicator 130 disposed near the receptacle 124 having the item.

Figure 7:
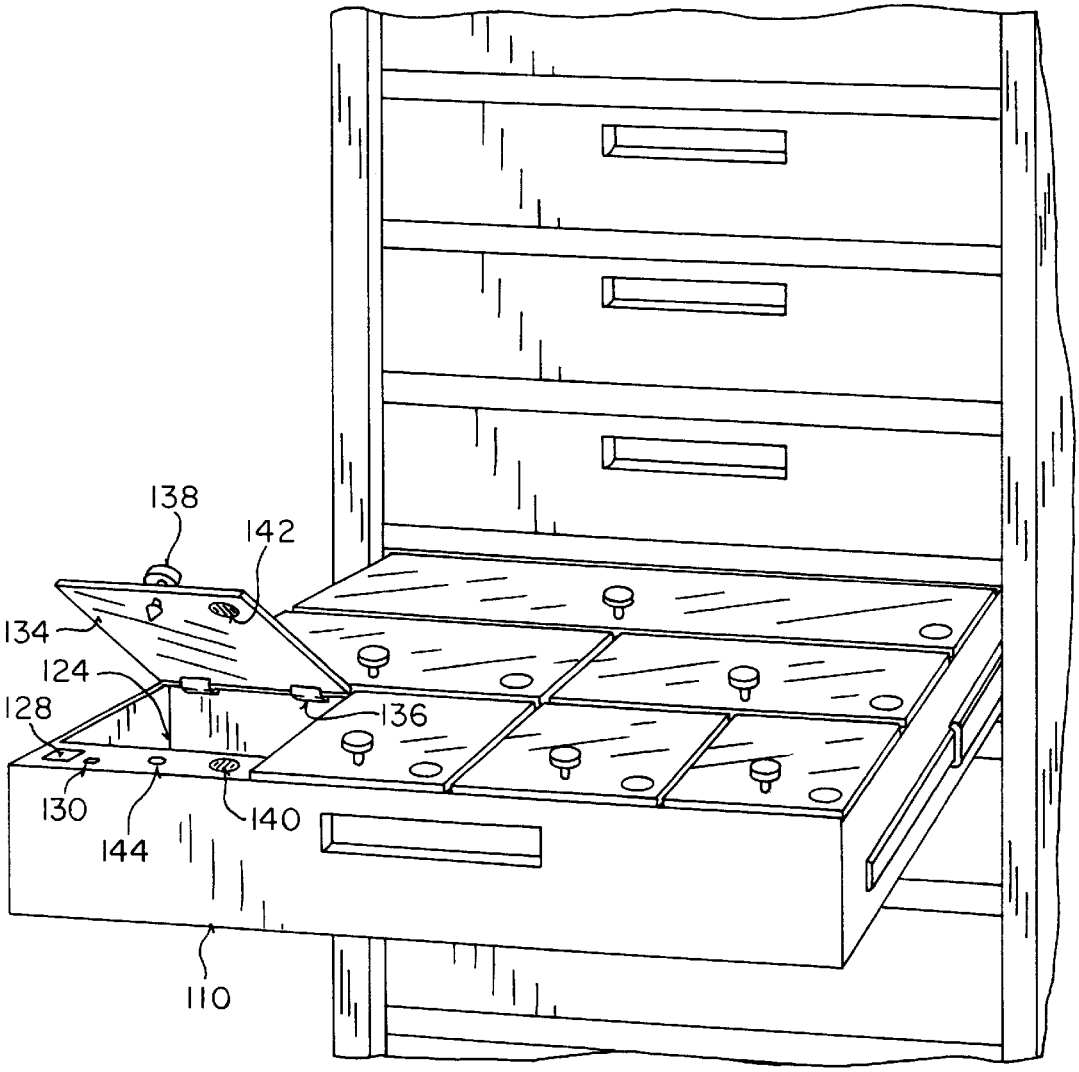
FIG. 7 illustrates an alternative embodiment of FIG. 6 showing a plurality of covers for each of the receptacles.

As shown in FIG. 7, the drawer 110 can be provided with a plurality of receptacle covers 134. The covers 134 are preferably connected to the drawer 110 by a hinge 136 so that the covers 134 can be lifted from the drawer 110 to obtain access to the receptacles 124. The covers 132 can be provided with a knob 138 to assist in lifting the cover 134.

A sensing mechanism comprising an electromagnetic sensor 140 and a magnet 142 are provided to sense when the cover 134 has been lifted. Alternatively, an optical sensor, a capacitative sensor, or the like could also be used to sense when the cover 142 has been lifted.

The electromagnetic sensor 140 sends a signal to the processor to indicate that the cover 134 has been lifted. This information can be used to record removal of an item from the receptacle 124 or can be stored and compared with item removal information entered by the button 128. If the cover 134 has been lifted more times than the button 128 was actuated, a report can be generated indicating that further user training or supervision may be required.

Preferably, the covers 134 will be substantially transparent so that the items in the receptacles 124 and the visual indicators 130 can be viewed with the cover 134 closed.

The drawer 110 can be provided with a lock 144 for locking the cover 134 until user identification and patient identification information have been entered into the processor. When the required information has been entered, the processor will send a signal to unlock the cover 134 making the receptacle 124 available for access.

Figure 8:
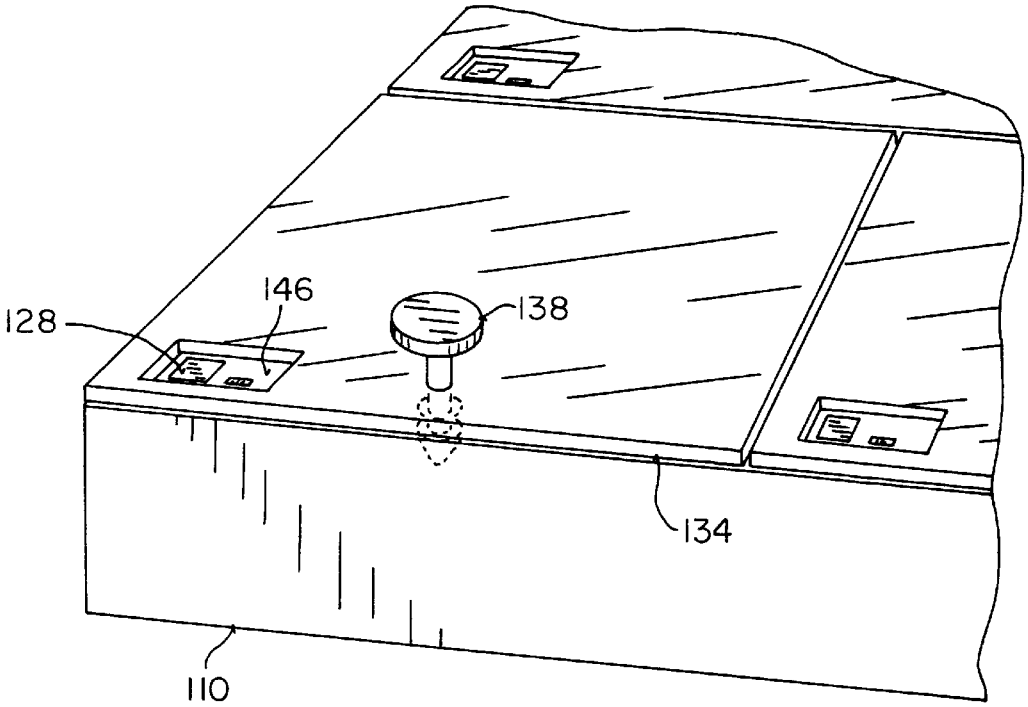
FIG. 8 is an alternative embodiment of the drawer of FIG. 7 showing an aperture in the cover to allow access to the touch-sensitive button and observation of the associated visual indicator when the cover is closed.

An alternative embodiment of the drawer 110 is shown in FIG. 8. One of the covers 134 is provided with an aperture 146 so that the button 128 is accessible when the cover 134 is closed. The aperture 146 is large enough to allow access to the button 128 but small enough to prevent access to the receptacle 124. When providing the cover 134 with the aperture 146, the cover 134 will preferably remain locked until the button 128 is actuated to indicate an item is to be removed. This ensures that the removal of at least one item will be recorded before the item is made available for removal. Locking the cover 134 also serves as a reminder that the buttons 128 should be depressed each time an item is withdrawn from a receptacle 124 and also ensures a record of removed items so that stock can be replenished.

The processor can also be configured to lock the covers 134 and deny access to selected receptacles 124 based on the user identification information entered into the processor. Depending upon the user's identification, access will only be provided to the receptacles 124 to which that particular user is entitled.

Figure 9:
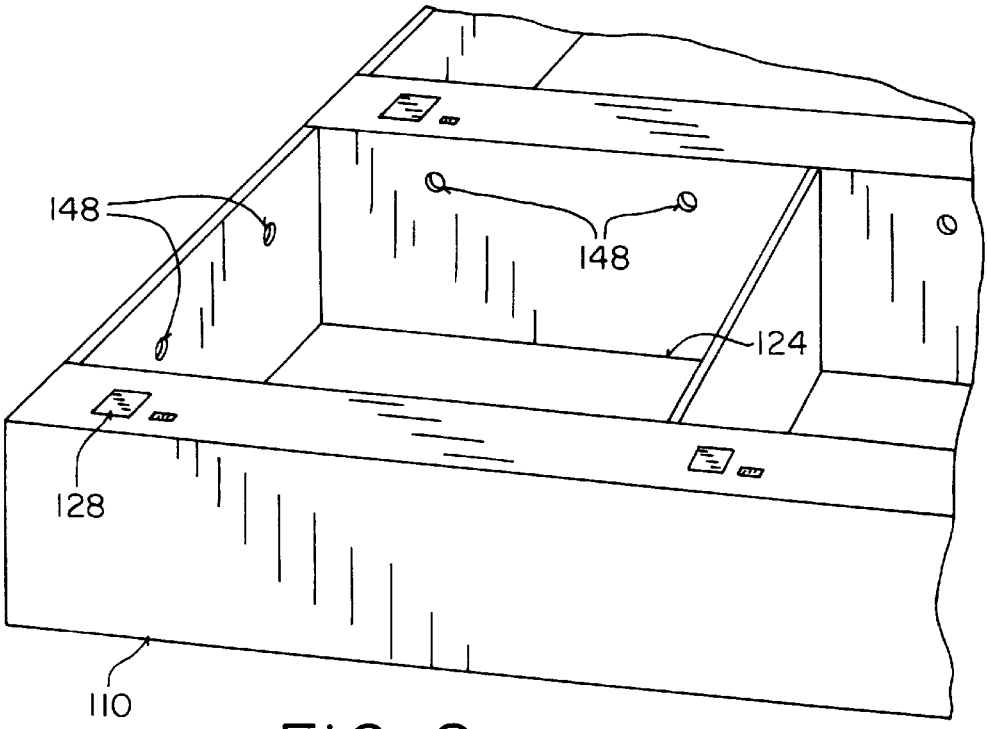
FIG. 9 illustrates another alternative embodiment of the drawer of FIG. 6 showing a plurality of optical sensors disposed within the drawer for sensing access to the receptacles.

Referring to FIG. 9, the drawer 110 is provided with a plurality of receptacle sensors 148 arrayed along the sides of the receptacle 124. The sensors 148 sense when a hand has entered the receptacle 124 to take or add an item. Each time the sensor is actuated, an entry is recorded. The touch sensitive button 128 can optionally be provided and used to register the number of items taken. If no items have been taken, i.e. if no buttons 128 have been actuated, the sensors 148 can be used to record that the receptacle 124 has been accessed by the user. If the receptacle 124 has been accessed and the button 128 has not been actuated, then the processor can record removal of items based on the number of entries into the receptacles 124.

The invention has been described in considerable detail for purposes of understanding. However, alternative embodiment of the invention will occur to those skilled in the art. Therefore, the above description should not be taken as limiting the scope of the invention. Instead, the scope of the invention should be determined chiefly with reference to the appended claims, along with the full scope of equivalence to which those claims are entitled.

What is claimed is:

1. A dispensing unit comprising:

an enclosure having an interior;

a plurality of storage locations distributed over a surface of the enclosure;

actuators associated with at least some of the individual storage locations;

a multiplicity of receptacles disposed within at least some of the storage locations;

actuators associated with at least some of the individual receptacles; and a processor disposed on the enclosure and connected to receive signals from the storage location-associated actuators and the receptacle-associated actuators, wherein the processor includes a record of the number and type of items held in the receptacles;

wherein access to one of the storage locations sends a signal from the storage-associated actuator to the processor, the processor using the signal to set the receptacle-associated actuators to correspond to the receptacles in the accessed storage location, and wherein removal of an item from one of the receptacles and actuation of the corresponding receptacle-associated actuator updates the record of items held in the receptacle.

2. The unit of claim 1, wherein at least one of the storage locations comprises a drawer.

3. The unit of claim 2, wherein the drawer includes at least one divider to form the multiplicity of receptacles.

4. The unit of claim 3, wherein the storage-location actuators comprise a switch disposed near each drawer for sensing the opening of the drawers.

5. The unit of claim 4, wherein the receptacle-associated actuators comprise touch-sensitive buttons.

6. The unit of claim 5, wherein the buttons are disposed in a row on the surface of the enclosure.

7. The unit of claim 6, wherein opening of one of the drawers sends a signal from the storage location-associated actuator to the processor, the processor using the signal to set the row of buttons to correspond to the receptacles in the accessed drawer.

8. The unit of claim 7, wherein the buttons correspond visually with the receptacles by a unique button identification symbol in close proximity and corresponding to each button and each receptacle, wherein selection of one of the buttons records removal of an item from the receptacle having the same identification symbol as the button.

9. The unit of claim 8, further comprising a horizontal shelf, wherein the buttons are disposed along the shelf, and wherein the drawers are slidably disposed along the shelf and are generally aligned with the buttons such that each button corresponds to the closest drawer.

10. The unit of claim 12, further comprising means for displaying a list of items held by the unit;

means for entering a selection from the list of the items held in the dispensing unit into the processor; and a plurality of visual indicators connected to the processor and in close proximity to the buttons, each button corresponding the closest visual indicator;

wherein entry of a selection from the list of items actuates the visual indicator corresponding to the drawer having the item.

11. The unit of claim 13, wherein access to the drawer having the item actuates the visual indicator corresponding to the button having the same identification symbol as the receptacle having the item.

12. The unit of claim 8, wherein each drawer includes a unique drawer identification symbol corresponding to the unique button identification symbols.

13. The unit of claim 9, further comprising means for displaying a list of items held by the unit;

means for entering a selection from the list of the items held in the dispensing unit into the processor; and a plurality of visual indicators connected to the processor and in close proximity to the buttons;

wherein entry of a selection from the list of items actuates the visual indicator in close proximity to the button having the same identification symbol as the drawer containing the item.

14. The unit of claim 10, wherein access to the drawer having the item actuates the visual indicator in close proximity to the button having the same indentification symbol as the receptacle having the item.

15. The unit of claim 1, wherein at least one of the storage locations comprises a rack having a plurality of pegs, the pegs defining the receptacles.

16. The unit of claim 15, wherein the storage-location actuators comprise a switch disposed near each rack for sensing the opening of the racks.

17. The unit of claim 16, wherein the receptacle-associated actuators comprise touch-sensitive buttons.

18. The unit of claim 17, wherein the buttons are disposed in a row on the surface of the enclosure.

19. The unit of claim 18, wherein opening of one of the racks sends a signal from the storage location-associated actuator to the processor, the processor using the signal to set the row of buttons to correspond to the pegs in the accessed rack.

20. The unit of claim 19, wherein the buttons correspond visually with the pegs by a unique button identification symbol in close proximity and corresponding to each button and each peg, wherein selection of one of the buttons records removal of an item from the peg having the same identification symbol as the button.

21. The unit of claim 20, further comprising a horizontal shelf, wherein the buttons are disposed along the shelf, and wherein the racks are slidably disposed along the shelf and are generally aligned with the buttons such that each button corresponds to the closest rack.

22. The unit of claim 21, further comprising means for displaying a list of items held by the unit;

means for entering a selection from the list of the items held in the dispensing unit into the processor; and a plurality of visual indicators connected to the processor and in close proximity to the buttons, each button corresponding the closest visual indicator;

wherein entry of a selection from the list of items actuates the visual indicator corresponding to the rack having the item.

23. The unit of claim 22, wherein access to the rack having the item actuates the visual indicator corresponding to the button having the same identification symbol as the peg having the item.

24. The unit of claim 1, further comprising means for selectively preventing access to the storage locations, and means for opening the preventing means to permit access to a desired receptacle in response to the input of patient identification information into the processor.

25. The unit of claim 24, wherein the storage locations comprise a plurality of racks, and wherein withdrawal of one the racks causes the preventing means to block access to all remaining racks.

26. The unit of claim 24, wherein the storage locations comprise a plurality of drawers, and wherein withdrawal of one the drawers causes the preventing means to block access to all remaining drawers.

27. The unit of claim 1, wherein the interior is accessible through a doorway, and wherein the unit further comprises means across the doorway for selectively blocking access to the receptacles while permitting access to the receptacle-associated actuators at all times, and means for opening the blocking means to permit access to a desired receptacle selected from the plurality of receptacles in response to a signal from one of the receptacle-associated actuators.

28. The unit of claim 1, further comprising a return item actuator disposed near the receptacle-associated actuators and in communication with the processor for toggling the receptacle-associated actuators between a removal mode and a return item mode.

29. A dispensing unit comprising:

an enclosure having an interior;

a plurality of pull-out compartments on the enclosure, wherein at least some of the compartments include an array of receptacles;

an actuator adjacent to and associated with each of the receptacles, the actuators being disposed in the compartments, wherein transfer of an item to or from each receptacle may be recorded by actuation of the sensor;

a processor disposed on the enclosure and connected to receive signals from the actuators;

a compartment-associated visual indicator on each pull-out compartment;

a receptacle-associated visual indicator in close proximity and corresponding to each receptacle, the receptacle-associated visual indicators being separate from the compartment associated receptacles and being held within the enclosure when the pull-out compartment is an a closed position;

means for displaying a list of items held by the unit;

means for entering a selection from the list of the items held in the dispensing unit into the processor; and wherein entry of a selection from the list of items actuates the compartment-associated visual indicator on the compartment having the item and the receptacle-associated visual indicator in close proximity to the receptacle having the selected item.

30. The unit of claim 29, wherein at least some of the compartments comprise drawers having dividers to form the receptacles.

31. The unit of claim 30, wherein the actuators comprise touch-sensitive buttons disposed on the drawers adjacent each of the receptacles.

32. The unit of claim 30, wherein the actuator is an optical actuator disposed along a side of the drawer.

33. The unit of claim 31, wherein the dividers are adjustable, and wherein the unit further comprises an actuator cover for preventing access to selected actuators based on the adjustment of the dividers.

34. The unit of claim 33, wherein each receptacle-associated visual indicator corresponds to the receptacle of the closely disposed touch-sensitive button.

35. The unit of claim 29, further comprising a cover over each of the receptacles.

36. The unit of claim 35, wherein the covers are connected to the dividers by hinges.

37. The unit of claim 35, further comprising sensing means for sensing when the covers have been displaced.

38. The unit of claim 37, wherein the sensing means comprises an electromagnetic sensor.

39. The unit of claim 37, wherein the sensing means comprises an optical sensor.

40. The unit of claim 37, wherein the covers are substantially transparent to allow visual access to the receptacles.

41. The unit of claim 37, further comprising cover locks for preventing access to the receptacles, and wherein the locks are connected to the processor by at least one wire to place the locks in electrical communication with the processor, the processor providing signals to lock or unlock the covers.

42. The unit of claim 41, wherein the processor sends a signal to unlock the cover after user and patient identification information have been entered into the processor.

43. The unit of claim 42, wherein the buttons are disposed beneath the covers, and wherein an aperture is disposed in each of the covers, the aperture being aligned with the button, whereby the buttons can be accessed through the apertures while the covers are closed.

44. The unit of claim 43, wherein actuation of a button unlocks the cover for the associated receptacle.

45. The unit of claim 29, wherein at least some of the compartments comprise racks, and wherein the receptacles are disposed along pegs on the racks.

46. The unit of claim 45, wherein the actuators are disposed on the pegs for sensing when an item has been removed from the associated peg.

47. The unit of claim 45, wherein the actuators are disposed along the and near each peg.

48. The unit of claim 47, wherein the actuators comprise touch-sensitive buttons.

49. The unit of claim 48, wherein each receptacle-associated visual indicator is in close proximity to each corresponding button.

50. The unit of claim 29, further comprising a return item actuator disposed near the receptacle-associated actuators and in communication with the processor for toggling the receptacle-associated actuators between a removal mode and a return item mode.

51. A method for recording inventory information related to removal and addition of medical or pharmaceutical items from a location within a dispensing unit defining an enclosure, said enclosure including a processor having a record of the number and type of the items stored in the enclosure based on their location in the enclosure, said method comprising:

accessing the enclosure and sensing access with a first actuator on the enclosure to produce a first signal associated with the location of a receptacle, wherein the first actuator senses access by withdrawing a drawer or a rack holding the item at least partially from the enclosure;

accessing a location on the drawer or rack holding the item;

sensing access of the receptacle with a second actuator on the enclosure to produce a second signal associated with the location of the receptacle;

transferring an item from or to the receptacle; and recording the transfer in the processor based on an address of the location based at least in part on the first and second signals.

52. The method of claim 51, wherein the second actuator senses access by removal of the item or by touching a button corresponding to the location of the item on the drawer or rack.

53. The method of claim 52, further comprising selecting the item to be removed or added from a list of items, wherein selection of the item from the list actuates a visual indicator in close proximity to the drawer or rack having the item.

54. The method of claim 52, further comprising actuating a visual indicator in close proximity to the button corresponding to the location of the item on the drawer or rack after the drawer or rack has been withdrawn.

55. The method of claim 54, further comprising providing a unique button identification symbol in close proximity to the button and the location of the item.

56. The method of claim 55, wherein the button is actuated after visually locating the button identification symbol near the location of the item to be dispensed and visually locating the button having the same identification symbol.

57. The method of claim 56, further comprising preventing access to the items until patient identification information has been entered into a processor on the dispensing unit.

58. A dispensing unit comprising:

an enclosure having an interior;

a plurality of storage locations distributed over a surface of the enclosure;

actuators associated with at least some of the individual storage locations;

a multiplicity of receptacles disposed within at least some of the storage locations;

actuators associated with at least some of the individual receptacles;

a processor disposed on the enclosure and connected to receive signals from the storage location-associated actuators and the receptacle-associated actuators;

means for displaying a list of items held by the unit;

means for entering a selection from the list of the items held in the dispensing unit into the processor; and a plurality of visual indicators on the enclosure which are connected to the processor, wherein each visual indicator is associated with a unique identification symbol;

wherein each storage location is marked with a unique identification symbol corresponding to at least some of the visual indicator-associated identification symbols, and wherein each receptacle is marked with a unique identification symbol corresponding to at least some of the visual indicator-associated identification symbols;

wherein entry of a selection from the list of items actuates the visual indicator associated with the same identification symbol as the storage location containing the item, and wherein access to the storage location having the item actuates the visual indicator having the same identification symbol as the receptacle having the item.

59. A method for recording inventory information related to removal and addition of items to or from a dispensing unit having arrays of receptacles disposed in a plurality of holding apparatus, with each array being disposed in a separate holding apparatus, the method comprising:

inputting item identification information into the dispensing unit to select an item to be transferred;

actuating a first visual indicator on the holding apparatus having the selected item and a second visual indicator adjacent the receptacle having the selected item;

at least partially withdrawing the holding apparatus having the actuated first visual indicator;

visually locating the actuated second visual indicator on the withdrawn holding apparatus to locate the selected item;

transferring the selected item to or from the receptacle; and actuating a touch-sensitive button in close proximity and corresponding to the receptacle having the item to record removal or addition of the item.

60. A dispensing unit comprising:

an enclosure having an interior;

a plurality of pull-out compartments on the enclosure, wherein at least some of the compartments include an array of receptacles;

an actuator associated with and in close proximity to each of the receptacles;

a processor disposed on the enclosure and connected to receive signals from the actuators;

wherein at least some of the compartments comprise drawers having fixed dividers and adjustable dividers to form the receptacles, wherein the actuators comprise touch-sensitive buttons disposed along the fixed dividers so that each receptacle has at least one button, wherein at least some of the receptacles have more than one touch-sensitive button based on placement of the adjustable dividers, and wherein the unit further comprises actuator covers which are disposed over some of the actuators so that each receptacle has only one uncovered sensor.

61. A method for recording inventory information related to removal and addition of items from an enclosure having an array of receptacles disposed in a holding apparatus, the method comprising:

at least partially withdrawing the holding apparatus from the enclosure;

visually locating the item to be removed or added;

removing the item from the receptacle or placing the item into the receptacle;

sensing when the receptacle has been accessed and producing a record of the access;

providing an actuator in close proximity and corresponding to the receptacle having the item, wherein the actuator may be touched to record the transfer of the item;

comparing the record of receptacle access with the record of item transfer to determine if a discrepancy exists between the record of receptacle access and the record of item transfer;

preventing access to the receptacles until user and patient identification information have been recorded; and preventing access to a selected number of the receptacles based on the user identification information.

* * * * *